United States Patent [19]

Sakamoto

[11] Patent Number: 4,504,716

[45] Date of Patent: Mar. 12, 1985

[54] ELECTRONIC DIGITAL TIMER

[75] Inventor: Kazuho Sakamoto, Kyoto, Japan

[73] Assignee: Matsushita Electric Industrial Co., Ltd., Osaka, Japan

[21] Appl. No.: 336,043

[22] Filed: Dec. 31, 1981

[30] Foreign Application Priority Data

Jan. 13, 1981 [JP] Japan ..... 56-4824
Jan. 13, 1981 [JP] Japan ..... 56-4825

[51] Int. Cl.[3] ..... H05B 6/64

[52] U.S. Cl. ..... 219/10.55 B; 368/74; 368/187; 340/309.15; 219/493

[58] Field of Search ..... 219/10.55 B, 10.55 M, 219/493; 340/309.1, 309.2, 309.3, 309.4; 368/107–113, 74, 188, 187

[56] References Cited

U.S. PATENT DOCUMENTS

| | | | |
|---|---|---|---|
| 4,321,697 | 3/1982 | Meisner et al. | 368/187 |
| 4,348,753 | 9/1982 | Werner et al. | 368/188 |
| 4,367,387 | 1/1983 | Tachihara et al. | 219/10.55 B |
| 4,415,273 | 11/1983 | Hoffman et al. | 368/74 |

*Primary Examiner*—Roy N. Envall, Jr.
*Assistant Examiner*—M. M. Lateef

[57] ABSTRACT

An electronic digital timer for displaying time information on an electronic digital display device such as a fluorescent display tube. A time setting knob is employed to set time information. By operating the time setting knob in an analog fashion, time information is displayed on the electronic digital display device in a digital fashion.

3 Claims, 14 Drawing Figures

| LEVEL | 9 | 10 | 11 |
|---|---|---|---|
| COMPARATOR OUTPUT | 0 | 0 | 0 |
| | 0 | 0 | 0 |
| | 1 | 1 | 1 |
| | 0 | 0 | 0 |
| | 0 | 1 | 1 |
| | 1 | 0 | 1 |
| TIME | 00 09 | 00 10 | 00 11 |

ELECTRONIC DIGITAL TIMER

DESCRIPTION OF THE INVENTION

This invention relates to an electronic digital timer and more particularly to an improved electronic digital timer capable of setting time in an analog fashion by operating time setting means and controlling an operation of auxiliary electric or electronic apparatus.

In recent years, electronic digital timers have been used by combining them with various electric or electronic apparatus such as microwave ovens, digital tuning radio receivers or television receivers and video tape decks. Such electronic digital timers are used both as clocks, to inform users of the present time, and as interval timers, to set time intervals such as cooking time intervals for microwave ovens. A typical control panel for a microwave oven having a conventional electronic digital timer includes a display section which may comprise a plurality of seven-segment type light emitting diode display devices and a digit key section which includes ten numeral keys for the decimal numerals 0–9 for changing the numeric display on the display section and being operated by setting, for example, time intervals for cooking. The panel may also include a cooking mode selection section having various cooking mode keys such as a "HIGH POWER" key for obtaining a high power microwave output from a magnetron and a "COOK" key for starting of the cooking operation. When the oven is in a normal condition, prior to cooking, a present time display appears on the display section to inform the user of the present time. That is, at this time, the electronic digital timer including the display section and the digit key section is operated as an ordinary digital clock. If the user desires to cook by the high power output from the magnetron for 12 minutes and 34 seconds, for example, the "HIGH POWER" key on the cooking mode selection section is first selected and actuated. By this operation, the present time display disappears and a "0000" and "HIGH" displays appear on the display section. To set the cooking time interval for 12 minutes and 34 seconds, the "1" digit key is selected and actuated after the appearance of "0000" display. By this operation, the display section provides a display "0001". By sequential actuations of further digit keys "2", "3" and "4", the display pattern on the display section varies and "1234" display appears on the display section. Setting of the cooking time interval "1234" (12 minutes and 34 seconds) is completed. Under this condition, actuation of the "COOK" key starts the cooking which lasts for 12 minutes and 34 seconds.

Setting cooking time by the use of a plurality of digit keys, however, has many disadvantages, among which are: (1) persons who have long experience with analog type timers (for example, mechanical rotary-type timers) often find it difficult to operate digit keys and often take a longer period of time to familiarize themselves with the digital timer having a plurality of digit keys; (2) when, for example, the user sets the wrong cooking time, they must set the correct cooking time again after putting the display on the display section back in its initial display condition "0000"; and (3) wide space is necessary to provide ten digit keys on the digit key section of the panel.

The present invention, therefore, has as its principal object to provide an improved electronic digital timer which eliminates disadvantages, including those mentioned above, of a conventional digital timer.

Another object of this invention is to provide an electronic digital timer which has a display in a digital fashion and is capable of time setting (for example, cooking initiating time setting, cooking time interval and present time setting) in an analog fashion which is familiar to many persons through use of conventional mechanical timers.

A further object of the invention is to provide an electronic digital timer in which the digital time display pattern is varied by operating a single control knob.

Still another object of the invention is to provide an electronic digital timer having a stable display unaffected by noise.

A still further object of the invention is to provide an electronic digital timer in which a time display is easy to adjust.

These and other objects are accomplished by an electronic digital timer for displaying time information on an electronic digital display device according to the present invention, which timer comprises time setting means adjustable to provide selected time settings, a time setting circuit for producing an output voltage corresponding to the position of the time setting means, converting means for converting the output voltage of the time setting circuit into a digital signal corresponding to the output voltage and display control means coupled to the electronic digital display device for producing display control signals in response to the digital signal for causing time information to be displayed on the electronic digital display device.

In a first particular embodiment of the invention, the time setting circuit includes a variable resistor having a movable arm, the position of the movable arm being controlled by the operation of the time setting means and the output voltage being determined by the selecting position of said movable arm. The converting means includes a digital-to-analog converter for converting a reference input digital signal into a corresponding reference output voltage, a comparator for comparing the output voltage of the time setting circuit with the reference output voltage and producing a comparator output signal indicative of the results of such comparison and a processing circuit for providing the reference input digital signal and which is coupled to receive the comparator output signal for changing the reference input digital signal in response to the comparator output signal and which stores the comparator output signal as the digital signal corresponding to the comparator output voltage. The display control means includes a circuit for receiving the digital signal from the converting means after completion of the converting operation of the converting means and for changing the form of the digital signal to a signal capable of driving the electronic digital display device.

In a second particular embodiment of the invention, for a particular time setting, there is a difference between the position of the time setting means during the course of incrementing the display and the position of the time setting means during the course of decrementing the display, whereby one particular time display is obtained within a range of the position of the time setting means and the time display is stably maintained even when noise affects the circuit of the timer.

A third particular embodiment of the invention further includes time setting adjustment means for selection of a present time display mode and a time adjustment mode, the time adjustment mode being divided into a hours setting mode and a minutes setting mode, and the time setting circuit introduces time information in hours in the hours setting mode and introduces time information in minutes in the minutes setting mode.

In a fourth particular embodiment of the invention, an electronic digital timer is provided for use in controlling the operation of an auxiliary device during a selected time interval, during which the auxiliary device will operate, includes a variable resistor having a movable arm, the position of which is controlled by the time setting knob, for providing an output voltage determined by the position of the movable arm, a digital-to-analog converter for converting a reference input digital signal into a corresponding reference output voltage, a comparator for comparing the output voltage of the time setting circuit with the reference output voltage and producing a comparator output signal indicative of the results of such comparison, a processing circuit for producing the reference input digital signal and coupled to receive the comparator output signal for changing the reference input digital signal in response to the comparator output signal and which stores the comparator output signal as the digital signal corresponding to the output voltage, a display control circuit for reading out the stored digital signal after completion of the converting operation, a display driving circuit coupled to receive the stored digital signal for displaying the time interval corresponding to the stored digital signal and control means coupled to the processing circuit for selectively controlling the auxiliary device during the selected time interval displayed on the electronic digital display device.

According to the invention as described above, the following benefits, among others, are obtained:

(1) An improved electronic digital timer which is easy to operate, in particular, to persons who have long experience with analog-type timers.

(2) An improved electronic digital timer in which it is easy to correct the time setting thereon.

(3) A small size electronic digital timer.

(4) An improved electronic digital having a display which is stable and not changed by noise.

(5) An improved electronic digital timer in which time is easy to adjust.

While the novel features of the invention are set forth particularly in the appended claims, the invention, both as to organization and content, will be better understood and appreciated, along with other objects and features thereof, from the following detailed description taken in conjunction with the drawings, in which:

FIG. 1 is a front perspective view of a control panel portion of a microwave oven having a conventional electronic digital timer;

FIGS. 2(*a*)–2(*f*) are representative of portions of the control panel of FIG. 1 used for explanation of how cooking time is set by the use of the electronic digital timer of FIG. 1;

FIG. 3 is a front perspective view of a control panel portion of a microwave oven having a preferred embodiment of an electronic digital timer of the present invention;

FIGS. 4(*a*)–4(*d*) are representative of portions of the control panel of FIG. 3 used for explanation of how cooking time is set by the use of the electronic digital timer of FIG. 3;

Figure 1:
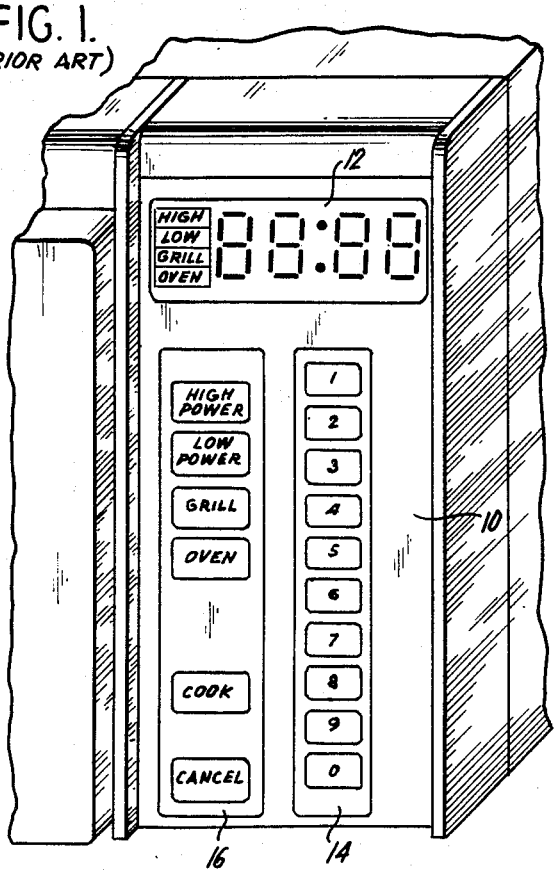
FIG. 1. (PRIOR ART)

Referring to FIG. 1, there is shown a portion of a microwave oven including a control panel 10 and a conventional electronic digital timer. Control panel 10 includes a display section 12 and a digit key section 14 which includes ten numeral keys for the decimal numerals 0–9. These digit keys are used for changing the numeric dispaly on the display section 12 and are operated for setting, for example, time intervals for cooking. The panel 10 also includes a cooking mode selection section 16 which includes various cooking mode keys, such as a "HIGH POWER" key for obtaining a high power microwave output from a magnetron and a "COOK" key for starting the cooking operation.

Figure 2:
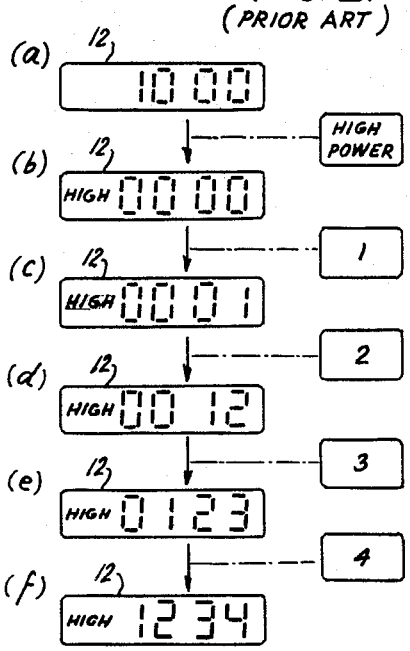
FIG. 2. (PRIOR ART)

Referring to FIG. 2, when the oven is in a normal condition, prior to cooking, a present time display (for example, 10 o'clock) appears on the display section 12 as shown in FIG. 2(*a*) to inform the user of the present time. That is, at this time, the electronic digital timer including the display section 12 and the digit key section 14 is operated as an ordinary digital clock. When the user desires to cook by the high power output from the magnetron, for example, for 12 minutes and 34 seconds, the "HIGH POWER" key on the cooking mode selection section 16 is first pressed. By this operation, the present time display disappears and "0000" and "HIGH" displays appear on the display section 12 as shown in FIG. 2(*b*). To set the cooking time interval of 12 minutes, 34 seconds, the "1" digit key is pressed after the appearance of "0000" display. By this operation, the display section 12 provides a display "0001" as shown in FIG. 2(*c*). By sequential pressing of further digit keys "2", "3" and "4", the display on the display section 12 varies, as shown in FIGS. 2(*d*)–2(*f*) and "1234" display appears on the display section 12 and setting of the cooking time interval "1234" (12 minutes and 34 seconds) is completed. Under this condition, pressing of the "COOK" key on the cooking mode selection section 16 starts the cooking which will automatically terminate at 12 minutes and 34 seconds.

Figure 3:
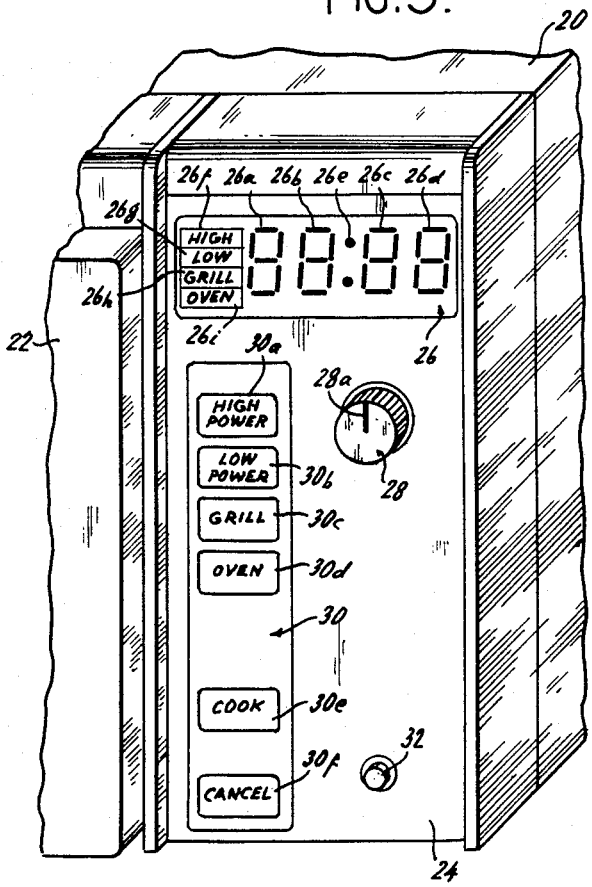

Referring now to FIG. 3, there is illustrated a microwave oven, generally designated by the numeral 20, including an electronic digital timer constructed in accordance with and embodying the features of the present invention. The oven is conventional and includes a front-opening access door 22 to open and close an oven cooking cavity (not shown), which door is shown in FIG. 3 in its fully closed position.

The oven 20 has a control panel 24 provided on the front right side of the oven for providing control of the microwave oven cooking functions. The control panel 24 has a display section 26, a time setting knob 28, a cooking mode selection section 30 and a time adjusting button 32. The display section 26, the time setting knob 28 and the time adjusting button 32 are included in the electronic digital timer. The display section 26 may comprise an electronic character display device such as light emitting diodes, a fluorescent display tube, a liquid crystal display device or the like. In any case, the electronic character display device includes a plurality of seven-segment type numeral display elements 26*a*–26*d* for time display, a colon display element 26*e* between the hour display elements 26*a*,26*b*, and minute display elements 26*c*,26*d* displayed during the present time display mode and a plurality of cooking mode display elements 26*f*–26*i* such as "HIGH, "OVEN". A time setting knob 28 is mounted rotatably on the control panel 24 for changing the time display pattern on the digital time display section 26 by rotating knob 28. Index mark 28*a* on the top surface of the knob 28 points to a rotating position of the knob 28. The cooking mode selection section 30 comprises a plurality of cooking mode selection keys 30*a*–30*f*, such as a "LOW POWER" key 30*b*, for obtaining a low power microwave output from a magnetron, a "GRILL" key 30*c*, for causing the microwave oven to be functioned as a grill, and a "COOK" key 30*e* for starting the cooking operation. These keys activate switches, as described below, which switches are rendered conductive or cut-off upon pressing said cooking mode selection keys. The time adjusting button 32 is used to adjust the present time display on the display section 26.

Figure 4:
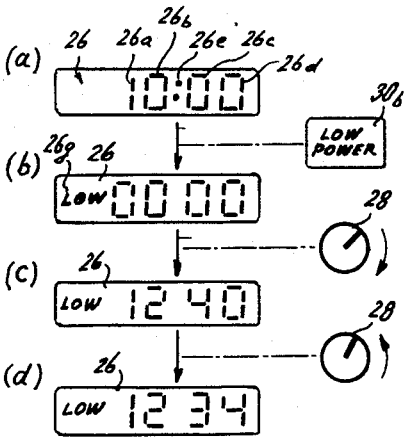

FIG. 4 shows one way to operate the digital timer of FIG. 3, in particular, to set a cooking time interval. When the oven 20 is in the normal condition prior to cooking, the present time display (for example, "10:00"; 10 o'clock) appears on the digital time display section 26, as shown in FIG. 4(*a*), to inform the user of the present time. At this time, numeral display elements 26*a*–26*d* and colon display element 26*e* are operated. When the user desires to cook by the low power microwave output for 12 minutes and 34 seconds, the "LOW POWER" key 30*b* on the cooking mode selection section 30 is first pressed. By this operation, the present time display disappears and the numbers "0000" and the word "LOW" appear on the time display section 26, as indicated in FIG. 4(*b*). That is, at this time, numeral display elements 26*a*–26*d* and "LOW" cooking mode display element 26*g* are operated. Under this condition, the time setting knob 28 is turned clockwise and time from "0000" until "1240" (12 minutes and 40 seconds) displayed, as shown in FIG. 4(*c*). The time setting knob 28 is turned counter-clockwise from the position of FIG. 4(*c*) and until the time "1234" is displayed, as shown in FIG. 4(*d*). Thus, the cooking time interval of 12 minutes, 34 seconds is set and displayed corresponding to the angular position of the time setting knob 28. Under this condition, pressing of the "COOK" key 30*e* starts the cooking which will automatically terminate at 12 minutes and 34 seconds.

Figure 5:
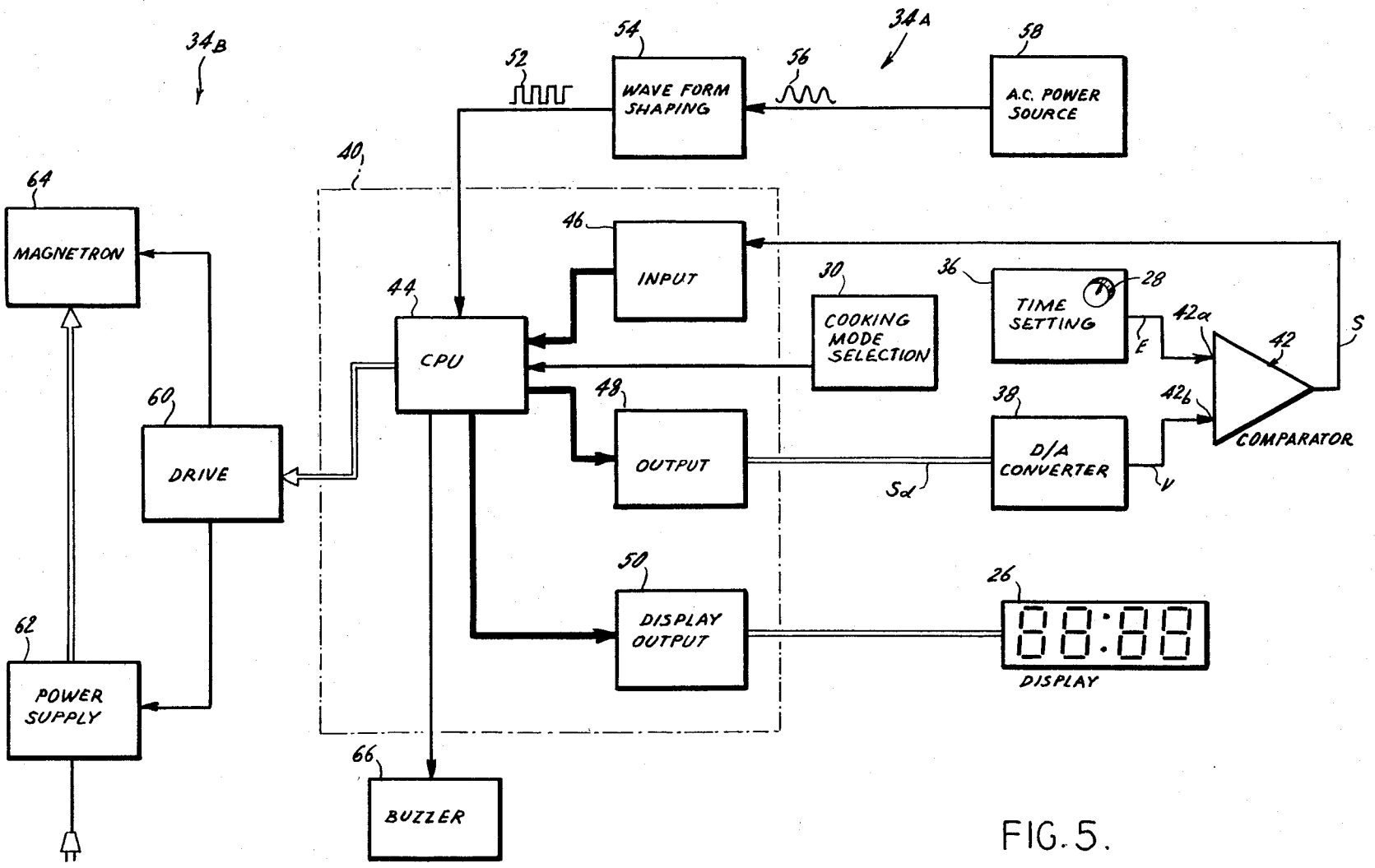
FIG. 5 is a schematic block diagram of one embodiment of circuitry used in the microwave oven of FIG. 3 to control the electronic digital timer of the present invention.

FIG. 5 shows the schematic block diagram of circuitry for the above-mentioned operational sequence. This circuitry may be divided roughly into two portions. A first portion 34A is used for converting an analog signal corresponding to the setting position of the time setting knob 28 into a digital signal to be displayed on the display section 26. A second portion 34B is used for controlling a cooking operation of the microwave oven 20.

The principle of operation for the first portion 34A will now be described. A time setting circuit 36 produces an analog output voltage E corresponding to the angular position of the time setting knob 28. A digital-to-analog (D/A) converter 38 produces an analog reference voltage V corresponding to a digital reference input signal Sd thereof, which is changed periodically by a microcomputer 40. A comparator 42 compares the output voltage E with the reference voltage V and produces a comparator output signal S which is "H" (binary "1") when output voltage E is higher than reference voltage V and which is "L" (binary "0") when output voltage E is lower than reference voltage V. The comparator output signal S is transferred to a central processing unit (CPU) 44 of the microcomputer 40 through an input port 46 and stored in a memory circuit (not shown) of CPU 44. At the same time, on the basis of the stored signal, CPU 44 changes the reference input digital signal Sd through an output port 48. As a result, the reference voltage V is changed and the output voltage E is compared with the second reference voltage V in the comparator 42. The second comparator output signal S is transferred to CPU 44 and stored in the memory circuit. On the basis of two stored signals of CPU 44, CPU 44 changes the digital reference input signal Sd again for changing the reference voltage V. The output voltage E is compared with the third reference voltage V and the comparison result is stored in the memory circuit of CPU 44. At the same time, CPU 44 changes the reference input digital signal Sd on the basis of three stored digital signals, and then a fourth comparison operation is executed. Similar operations are repeated several times, the number of times being determined by the number of converting bits of D/A converter 38. After the completion of the comparison operations, the stored digital signals of the memory circuit of CPU 44 are transferred to the display section 26 through a display output circuit 50 to be displayed as time information corresponding to the position of the time setting knob 28.

The operation and structure will now be further described. When the user rotates the time setting knob 28 and fixes its position, the time setting circuit 36 produces an analog output voltage E corresponding to the angular position of the time setting knob 28. The time setting circuit 36 may be constructed by use of a variable resistor. The output voltage E of the time setting circuit 36 is applied to a first input terminal 42*a* of a comparator 42, which may be a differential amplifier, an operation amplifier or other well known comparator circuit. The second input terminal 42*b* of the comparator 42 is supplied with an analog reference voltage V from a digital-to-analog (D/A) converter 38. The D/A converter 38 converts a reference input digital signal consisting of a plurality of bits (for example, 6 bits) from a microcomputer 40 into the analog reference voltage V. The microcomputer 40 is programmed to sequentially change the reference signal six times during the comparison operation to obtain the binary equivalent of the analog output signal E. The first reference signal for all comparisons is preselected; the second to sixth reference signals are automatically changed on the basis of the result of the comparison of the comparator 42. The comparator 42 compares the output voltage E from the time setting circuit 36 with the analog reference voltage V from D/A converter 38 and produces the comparator output digital signal S. For example, when the output voltage E from the time setting circuit 36 is higher than the analog reference voltage V from D/A converter 38, the comparator output signal S of comparator 42 will be "H", and when the output voltage E from the time setting circuit 36 is lower than the analog reference voltage V from D/A converter 38, the comparator output signal S of the comparator 42 will be "L". The comparator output signal S is applied to the input port 46 of the microcomputer 40. The output digital signal of the input port 46 is applied to CPU 44 and stored in the memory circuit of CPU 44. At the same time, CPU 44 produces an output digital signal on the basis of the stored signal thereof. The output digital signal of CPU 44 is applied to the input terminals of D/A converter 38 as the reference input digital signal Sd through the output port 48 of the microcomputer 40. The analog reference voltage V of D/A converter 38 is changed corresponding to the reference input digital signal Sd. The output voltage E of the time setting circuit 36 is compared with the second reference voltage V in the comparator 42. The second comparator output signal S is also stored in the memory circuit of CPU 44 and CPU 44 changes the reference input digital signal Sd again on the basis of the two stored signals in the memory circuit for changing the reference voltage V. The output voltage E is compared with the third reference voltage V and the third comparator output signal S causes CPU 44 to change the reference input digital signal Sd of D/A converter 38. Similar operations are repeated, six times in all, after which the output voltage E of the time setting circuit 36 is converted into a digital signal consisting of six bits which are stored in the memory circuit of CPU 44. Therefore, the circuitry including D/A converter 38, the comparator 42, CPU 44, the input port 46 and the output port 48 is an analog-to-digital converter for converting the analog output voltage E from the time setting circuit 36 into the digital signal to be displayed on the display section 26 corresponding to said analog output voltage E. CPU 44 is controlled by a 50 Hz/60 Hz clock pulse 52 produced by a wave form shaping circuit 54, which circuit 54 converts an AC commercial power signal 56 having the frequency of 50 Hz/60 Hz from an AC power source 58 into a rectangular pulse wave. The clock pulse 52 is used as a timing signal in the above-mentioned analog-to-digital converting operation and as a second signal (in case of 60 Hz pulse) for time display. This converting operation will be more detailed later.

The digital signal stored in the memory circuit of CPU 44 is applied to the display section 26 through the display output circuit 50 of the microcomputer 40, which circuit 50 may be a binary-to-decimal converting circuit. After the comparison operation is completed, the time display pattern on the display section 26 is changed automatically by the clock pulse 52. For example, when the time display is the cooking time, it is counted down to zero, and when the time display is the present time, it is counted up in the usual way.

As stated above, the circuitry of FIG. 5 includes the second portion 34B for controlling the cooking operation which will now be described. The CPU 44 also receives an order signal from the cooking mode selection section 30 and produces an output signal to display a cooking mode on the display section 26. Furthermore, a CPU 44 produces a control signal to a control drive circuit 60 to start the cooking operation when the "COOK" key **30*e* on the cooking mode selection section 30 is actuated. At this time, the drive circuit 60 controls a power supply circuit 62 to apply a power supply voltage to a magnetron circuit 64 during the time interval set by the time setting knob 28. The time display of the set time interval is counted down after starting the cooking and the cooking operation is terminated when the cooking time display is returned to initial position "0000". At this time, a buzzer circuit 66 is operated by an order signal of CPU 44 to inform the user of termination of cooking. CPU 44 also produces a control signal to control the drive circuit 60 to change the microwave output power of the magnetron, depending upon whether the "HIGH POWER" key 30*a* or "LOW POWER" key 30*b*** is operated.

Figure 6:
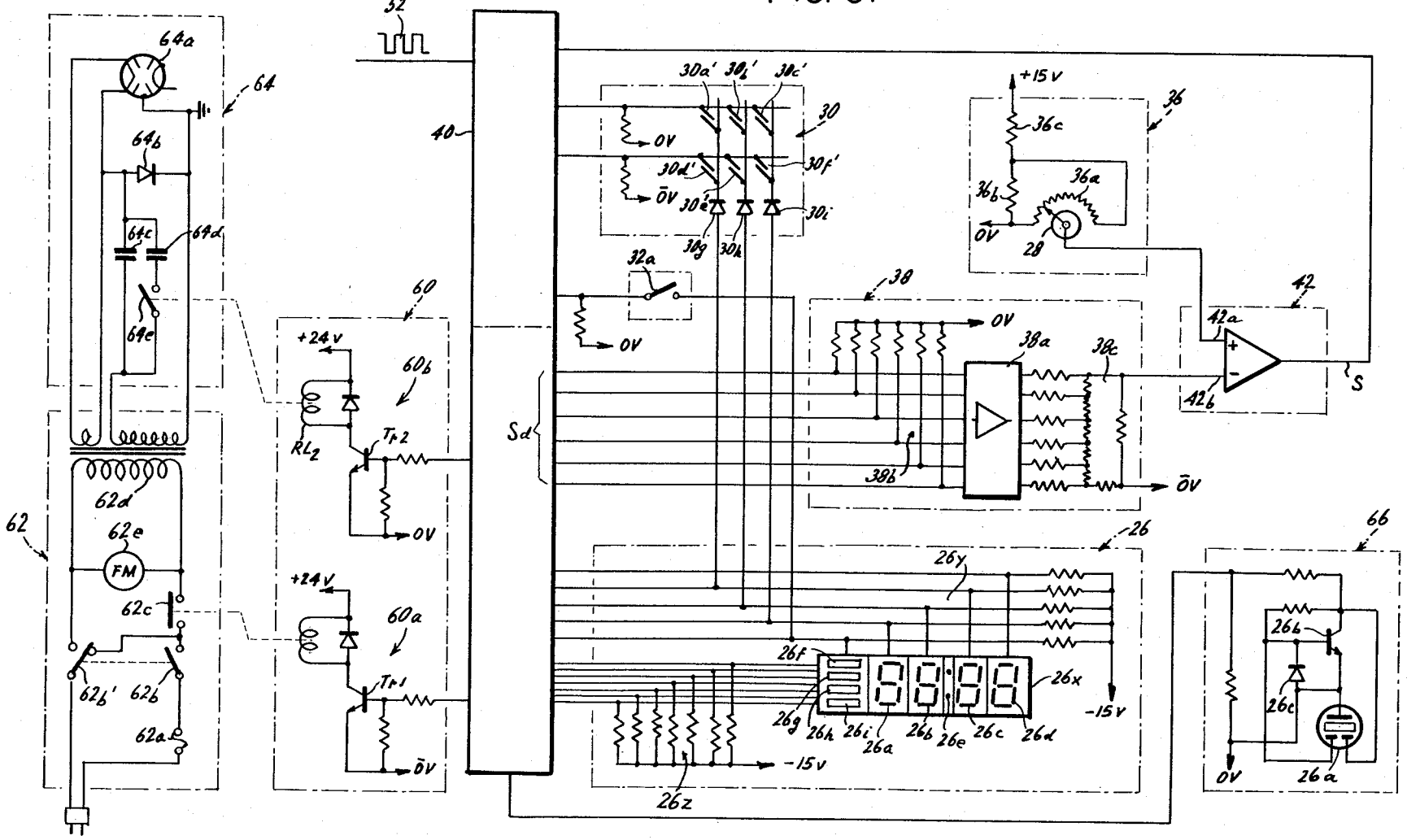
FIG. 6 is a schematic circuit diagram of portions of the circuitry of FIG. 5.

FIG. 6 shows the schematic circuit diagram of circuitry for some of the blocks of FIG. 5. Referring to FIG. 6, the time setting circuit 36 comprises a variable resistor **36*a*, a fixed resistor 36*b*, connected in parallel with variable resistor 36*a*, and a fixed resistor 36*c* having one end connected to one junction of resistors 36*a* and 36*b* and the other end connected to a source of voltage +15 V. The other junction of resistors 36*a* and 36*b* is connected to earth potential. The movable arm of variable resistor 36*a* which provides the output voltage of the time setting circuit 36 is connected to the positive input terminal 42*a* of comparator 42. The output voltage of the time setting circuit 36 is obtainable within the range of 0 V (when the movable arm of the variable resistor 36*a*** is connected to left side end thereof) and $$15\text{V} \times \frac{Rx}{Rx + R36c}\left(RX = \frac{R36a \cdot R36b}{R36a + R36b}\right)$$

(when the movable arm of the variable resistor **36*a*** is connected to right side end thereof).

The D/A converter 38 (FIGS. 6 and 7) comprises a buffer circuit **38*a*, an input bias circuit 38*b* consisting of six resistors, each having one end connected to earth potential, and the other end connected to six input terminals $D_0$–$D_5$ of the buffer circuit 38*a* respectively, and an output ladder network circuit 38*c*. The output ladder betwork circuit 38*c* consists of six resistors $R_0$–$R_5$, each having one end connected to six output terminals $A_0$–$A_5$ of the buffer circuit 38*a* respectively, five resistors $R_6$–$R_{10}$ connected between the other ends of adjacent resistors $R_5$–$R_0$ respectively, one resistor $R_{11}$ connected between the junction of resistors $R_0$,$R_{10}$ and earth potential and an output resistor $R_{12}$ connected between the junction of resistors $R_5$,$R_6$ and earth potential. The operation of the D/A converter 38** will be explained in detail below.

The display section 26 comprises an electronic character display device **26*x* (for example, a fluorescent display tube) having four numeral display elements 26*a*–26*d* (fluorescent anode electrodes), the colon display element 26*e* (fluorescent anode electrode) and four cooking mode display elements 26*f*–26*i* (fluorescent anode electrodes), a circuit 26*y* for driving the cathodes of said fluorescent display tube 26*x* respectively having five resistors and a circuit 26*z* for driving the anodes of said fluorescent display tube 26*x* respectively. The fluorescent display tube 26*x* is a well known device used, for example, with electronic digital tape counters or electronic recording/reproducing level meters of tape decks, and display portions of disk type electronic calculators. The fundamental display operation thereof is also well known and operates by having electrons emitted from the heated cathode move to the anode. When the electrons collide with the anode, the fluorescent material applied on the surface of the anode is energized to emit light for display. The cathode drive circuit 26***y* includes five resistors for heating the cathodes of the fluorescent tube 26*x*. One end of the resistors is connected to a power voltage −15 V and the other end of the resistors is connected to the output terminals of the display output circuit 50 of the microcomputer 40. The anode drive circuit 26*z* is used for applying appropriate voltage to the anodes of the fluorescent tube 26*x*. It includes seven resistors, one end of each being connected to a power voltage −15 V and the other end of each being connected to the output terminals of the display output circuit 50 of the microcomputer 40.

The cooking mode selection section 30 comprises key switches 30*a'*–30*f'*, corresponding to the cooking mode selection keys 30*a*–30*f* of FIG. 3, and diodes 30*g*–30*i*. These components form a 2×3 matrix circuit. The output terminals of the matrix circuit are connected to CPU 44 in microcomputer 40 and through resistors to earth potential. The input terminals of the matrix circuit are connected to the cathode drive circuit 26*y*. When a cooking mode key of FIG. 3 is pressed, a corresponding key switch is closed for transferring a cooking mode order signal corresponding to the actuated key switch to CPU 44.

The drive circuit 60 comprises at least two switching circuits 60*a*, 60*b*. Each switching circuit includes a switching transistor (Tr1, Tr2) and a relay solenoid ($RL_1$, $RL_2$), and is connected between a power voltage +24 V and earth potential. The first switching circuit 60*a* controls the power supply circuit 62 in response to the output signal of CPU 44 to supply a power voltage to the magnetron circuit 64 during the period of time when the output signal of CPU 44 appears. The second switching circuit 60*b* controls the output microwave power of the magnetron circuit 64 ("HIGH" or "LOW") in response to an output signal of CPU 44 produced in response to the operations of power select switch 30*a* or 30*b* on the cooking mode selection section 30 of control panel 24.

The power supply circuit 62 includes a fuse 62*a*, power switches 62*b*, 62*b'*, a relay switch 62*c* operated by the relay solenoid $RL_1$, a power transformer 62*d* and a cooling fan motor 62*e* for cooling the magnetron of the magnetron circuit. The magnetron circuit 64 includes the magnetron 64*a*, a diode 64*b*, capacitors 64*c*, 64*d* and a relay switch 64*e* operated by the relay solenoid $RL_2$. When the relay switch 64*e* is closed, the oscillating frequency of the magnetron 64*a* is reduced by parallel connection of two capacitors 64*c*, 64*d* and "LOW" microwave power is supplied from the magnetron 64*a*. On the other hand, when the relay switch 64*e* is opened, the frequency is raised and "HIGH" microwave power is supplied from the magnetron 64*a*. The buzzer circuit 66 includes a buzzer 66*a*, a transistor 66*b*, a diode 66*c* and three resistors.

The operation for converting the analog output voltage E of the time setting circuit 36 into the digital signal to be displayed on the display section 26 will now be described. The principle of the operation, as stated above briefly with reference to FIG. 6, is as follows: (1) by rotating the time setting knob 28 and fixing its position, the analog output voltage E, which corresponds to the angular position of the knob 28, is produced; (2) the first analog reference voltage V is produced by D/A converter 38, which voltage is predetermined by CPU 44; (3) the output voltage E is compared with the first reference voltage V by the comparator 42; (4) the comparator 42 produces a first comparator output signal S which is "H" when output voltage E is higher than reference voltage V and "L" when output voltage E is lower than reference voltage V; (5) the comparator output signal S is stored in the memory circuit of CPU 44 and causes CPU 44 to produce a signal for changing the reference input digital signal Sd of D/A converter 38 on the basis of the stored signal, thereby the reference voltage V is changed to the second reference voltage; (6) the output voltage E is compared with with second reference voltage V and the second comparator output signal S is stored in CPU 44; (7) on the basis of the first and second stored signals, CPU 44 changes the reference input digital signal Sd of D/A converter 38 and the reference voltage V is changed to the third reference voltage; (8) the output voltage E is compared with the third reference voltage V and similar operation is repeated; and (9) after the comparison operations are completed, six times in all, the six bits stored signal in CPU 44 is read out and transferred to the display section 26 through the display output circuit 50 to be displayed.

Figure 7:
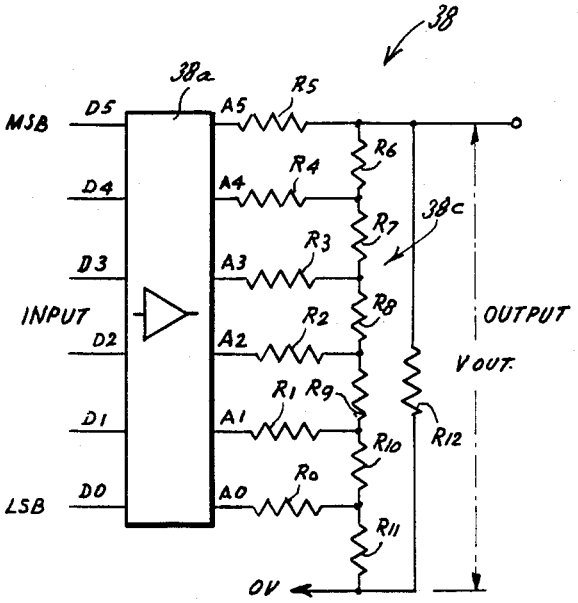
FIG. 7 is an enlarged circuit diagram of portions of a digital-to-analog converter shown in FIG. 6.
Figure 8:
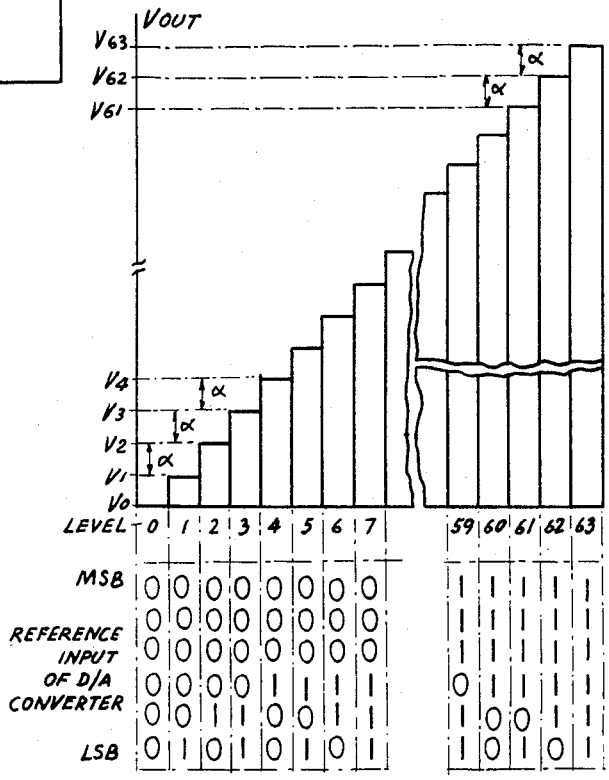
FIG. 8 is a graph used for explanation of operation of the digital-to-analog converter of FIG. 7.

More specifically, referring first to FIGS. 7 and 8, the operation of D/A converter 38 will be first described. FIG. 7 shows an example of D/A converter 38 of a 6-bit configuration. The buffer circuit 38*a* of the converter 38 is adapted such that it may deliver a given voltage Vc from each output terminal $A_0$–$A_5$ when a "1" digital signal is received at the corresponding input terminal $D_0$–$D_5$ from the microcomputer 40 and deliver 0 V when an "0" digital signal is received at the corresponding input terminal $D_0$–$D_5$. The output voltage Vout of the output ladder circuit 38*c*, therefore, bears a stepwise waveform corresponding to reference input digital signals as shown in FIG. 8. That is, for example, when D/A converter 38 receives a binary digital signal "000000" (decimal "0") on input terminals $D_5$–$D_0$ respectively from the microcomputer 40, the converter 38 produces 0 V (0 level) at its output terminal. When the converter 16 receives "000001" (decimal "1") on input terminals $D_5$–$D_0$ respectively, it produces a voltage Vout equal to $V_1$ (1 level, FIG. 8). When the converter receives "000010" (decimal "2") on input terminals $D_5$–$D_0$ respectively, it produces a voltage Vout equal to $V_2$ ($=V_1+X$; 2 level). When the converter 38 receives "000011" (decimal "3") on input terminals $D_5$–$D_0$ respectively, it produces a voltage Vout equal to $V_3$ ($=V_2+X$; 3 level). When the converter 38 receives "000100" (decimal "4") on input terminals $D_5$–$D_0$ respectively, it produces a voltage Vout equal to $V_4$ ($=V_3+X$; 4 level). The rest is operated likewise, as summarized by reference to the examples in the following table:

| | reference input digital signal Sd | | | | | | output voltage Vout (volt) |
|---|---|---|---|---|---|---|---|
| | $D^5$ | $D^4$ | $D^3$ | $D^2$ | $D^1$ | $D^0$ | (reference voltage V) |
| 0 | 0 | 0 | 0 | 0 | 0 | 0 | $V_0+0$ |
| 1 | 0 | 0 | 0 | 0 | 0 | 1 | $V_1$ |
| 2 | 0 | 0 | 0 | 0 | 1 | 0 | $V_2 = V_1 + X$ |
| 3 | 0 | 0 | 0 | 0 | 1 | 1 | $V_3 = V_2 + X = V_1 + 2X$ |
| : | | | : | | | | : |
| 39 | 1 | 0 | 0 | 1 | 1 | 1 | $V_{39} = V_{38} + X = V_1 + 38X$ |
| : | | | : | | | | : |
| 61 | 1 | 1 | 1 | 1 | 0 | 1 | $V_{61} = V_{60} + X = V_1 + 60X$ |

-continued

| | reference input digital signal Sd | | | | | | output voltage Vout (volt) |
|---|---|---|---|---|---|---|---|
| | $D^5$ | $D^4$ | $D^3$ | $D^2$ | $D^1$ | $D^0$ | (reference voltage V) |
| 62 | 1 | 1 | 1 | 1 | 0 | 1 | $V_{62} = V_{61} + X = V_1 + 61X$ |
| 63 | 1 | 1 | 1 | 1 | 1 | 1 | $V_{63} = V_{62} + X = V_1 + 62X$ |

As is apparent from the above table, the output voltage from D/A converter 38 varies stepwise from $V_1$ to $V_{63}$ and the coverter 38 produces 64 different levels of the output voltage Vout corresponding to 64 different reference input digital signals Sd. These 64 output voltages are used as the reference voltage V (FIG. 5) to be compared with the output voltage E of the time setting circuit 36.

Figure 9:
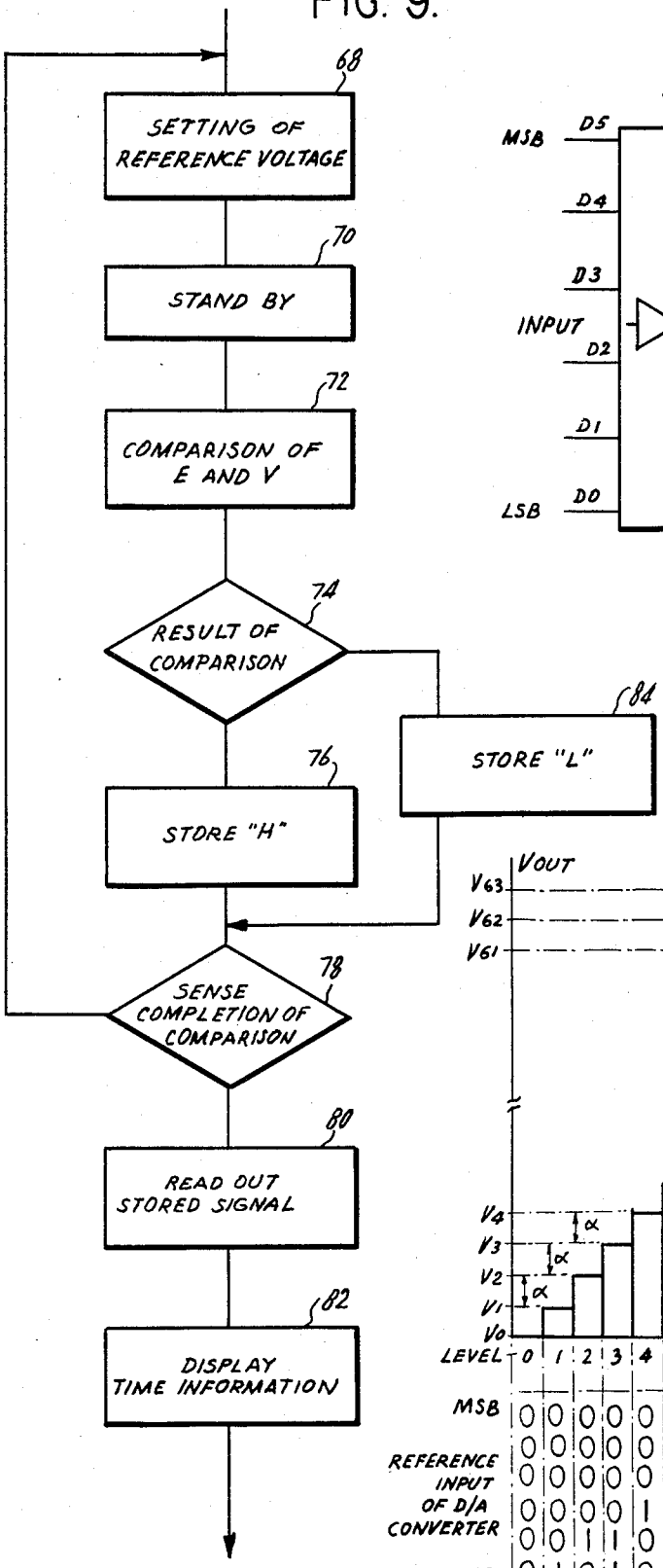
FIG. 9 is a flow diagram showing the sequence for setting the time in accordance with the embodiment of the electronic digital timer.
Figure 10:
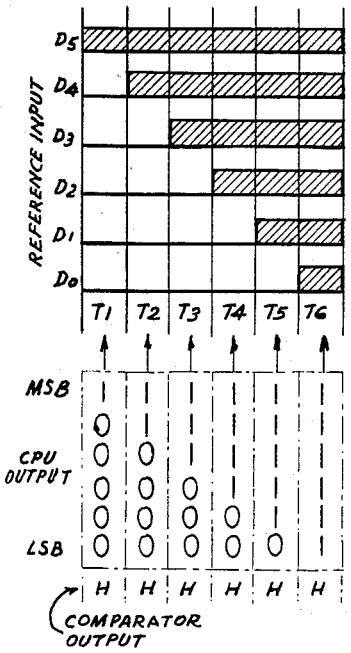
FIGS. 10–12 are graphical representations used for explanation of FIG. 9.
Figure 11:
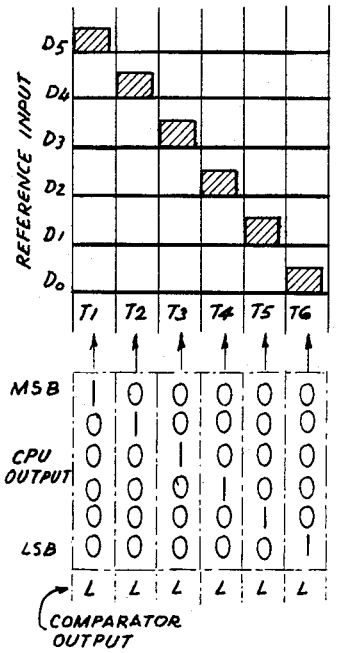
Figure 12:
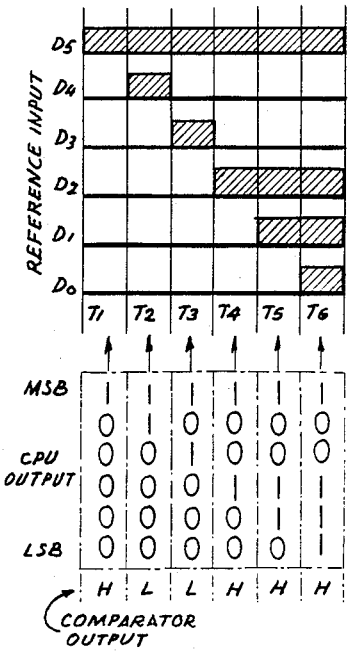

FIG. 9 shows the flow diagram for explaining the operation for converting the output voltage of the time setting circuit 36 into the digital signal to set the display output for the display section 26. FIGS. 10, 11 and 12 illustrate the operations for converting the analog output voltage E of the time setting circuit 36 corresponding to, for example, 63, 0, and 39 level from D/A converter 38 respectively into digital signals. In FIGS. 10–12, crosshatched portions of the reference input show a "1" signal and blank portions show a "0" signal. The principal converting sequences are as follows: (1) the analog output voltage E is first compared with the predetermined reference voltage $V_{32}$ corresponding to the first preselected reference input digital signal "100000"; (2) if the first comparator output signal is "H", the reference voltage is changed to $V_{48}$ corresponding to the reference input digital signal "110000", a first bit of which is stored "H" signals; (3) if the comparator output signal is "L", the reference voltage is changed to $V_{16}$ corresponding to the reference input digital signal "010000", a first bit of which is the stored "L" signal; (4) the analog output voltage E is compared with said second reference voltage, either $V_{48}$ or $V_{16}$; (5) if the second comparator output signal is "H", the reference voltage is changed to $V_{56}$ (when the first reference voltage is $V_{48}$) corresponding to the reference input digital signal "111000" and the first and second bits of which are stored "HH" signals; (6) if the second comparator output signal is "H", the reference voltage is changed to $V_{24}$ (when the first reference voltage is $V_{16}$) corresponding to the reference input digital signal "011000", first and second bits of which are stored "LH" signals; (7) if the second comparator output signal is "L", the reference voltage is changed to $V_{40}$ (when the first reference voltage is $V_{48}$) corresponding to the reference input digital signal "101000", first and second bits of which are stored "HL" signals, or changed to $V_8$ (when the first reference voltage is $V_{16}$) corresponding to the reference input digital signal "001000", first and second bits of which are stored "LL" signals; (8) the analog output voltage E is compared with the third reference signal $V_{56}$, $V_{24}$, $V_{40}$ or $V_8$ and similar operation is repeated; (9) after the comparison operation is repeated six times, CPU 44 detects the termination of the comparison operation; (10) six bits stored signal is read out from CPU 44 and transferred to the display section 26 through the display output circuit 50; and (11) the stored signal is displayed on the display section 26 as corresponding time information.

These sequences will now be explained in more detail.

Referring to FIGS. 5–10, the output voltage E of the time setting circuit 36 is higher than or equal to the reference voltage $V_{63}$ from D/A converter 38. In first step 68 of FIG. 9 for setting of reference voltage, the output signal of the output port 48 (the reference input digital signal Sd of D/A converter 38) is set automatically as "100000" having "1" at the most significant bit (MSB) position and "0" at the other bit positions. By this setting, the reference voltage $V_{32}$ of level 32 is produced from D/A converter 38 as a first reference voltage. Second step 70 of FIG. 9 is a standby step to accommodate response time of the circuit. In third step 72 of FIG. 9 for comparison of E and V, the output voltage E of the time setting circuit 36 corresponding to substantially 63 level is compared with said first reference voltage $V_{32}$ by the comparator 42 and the comparator 42 produces "H" comparator output signal. In fourth step 74 of FIG. 9 for transferring the comparison result, said "H" comparator output signal is transferred to the input port 46. In fifth step 76 of FIG. 9 for storing the comparison result, the comparator output signal "H" is stored in the memory circuit of CPU 44 at first store position (MSB position) thereof as "1". In sixth step 78 of FIG. 9 for sensing the completion of all comparison operations (six times), CPU 44 checks whether six times comparison operations are completed or not. In this case, CPU 44 decides to return the operation to first step 68 because the checking result is negative. The operation illustrated so far is conducted during time $T_1$ as shown in FIG. 10.

Similar operation is conducted during time $T_2$ after $T_1$. In the step 68 of second time interval, the reference input digital signal of D/A converter 38 is set as "110000", in which MSB "1" remains without change because comparison result was "H" ("1"), second bit is set newly as "1" and the rest remain as "0". By this setting, the voltage of level 48 ($V_{48}$) is produced from D/A converter 38 as a second reference voltage. In the step 72 after standby step 70, substantially 63 level output voltage E of the time setting circuit 36 is compared with the second reference voltage of level 48 ($V_{48}$). In this case, since the output voltage E of the time setting circuit 36 is substantially level 63, the comparison result is "H", as above; steps 74 and 76 are carried and and a second "H" level is stored in the memory circuit of CPU 44 at second store position (second significant bit position) as "1". Operation is returned to the step 68 again through the step 78.

Similar operation is conducted during time $T_3$ of FIG. 10 after $T_2$. In the step 68 of third time interval, the reference input digital signal of D/A converter 38 is set as "111000", in which upper two bits remain as "1", and the third bit is set newly as "1" and the rest remain as "0". By this setting, the voltage of level 56 ($V_{56}$) is produced from the converter 38 as a third reference signal. The substantially 63 level output voltage E of the time setting circuit 36 is compared with the third reference voltage of level 56 ($V_{56}$) and "H" level comparator output signal is produced, as above. The third "H" level comparator output signal is stored in the memory circuit at third store position (third significant bit position) as "1" and operation is returned to the step 68 again.

The above-mentioned operation is repeated at times $T_4$ and $T_5$ (FIG. 10) because the 63 level output voltage E of the time setting circuit 36 is higher than the voltage of level 60 ("111100") or level 62 ("111110"). In the case of time $T_6$, steps 68–76 are the same as above because the output voltage E of the time setting circuit 36 is also higher than the voltage of level 63 ("111111"). However, in the step 78 at time $T_6$, CPU 44 detects completion of the comparison operation for all six bits. Therefore, data "111111" stored in the memory circuit of CPU 44 is read out in the step 80 for reading out the stored signal and time (for example, cooking time interval) corresponding to the output voltage E of level 63 ("111111") is displayed on the display section 26 in the step 82 for displaying the time information.

The next example is the detection of 39 level as shown in FIG. 12. In this case, the output voltage of the time setting circuit 36 is within the range of level 39 and level 40 from D/A converter 38. In first step 68 of FIG. 9, the output signal of the output port 48 (the reference input digital signal of D/A converter 38) is automatically set as "100000", as above. In third step 72 through standby step 70 of FIG. 9, the reference voltage of level 32 ($V_{32}$) from the converter 38 is compared with the output voltage E of the time setting circuit 36 corresponding to substantially level 39 by the comparator 42 and the comparator 42 produces "H" comparator output signal. Steps 74–78 are the same as mentioned above. In the step 68 of second time interval, the reference voltage of level 48 ($V_{48}$) is produced and the comparison operation is conducted by the comparator 42. In this case, the output voltage E of the time setting circuit 36 (about level 39) is lower than said reference voltage of level 48. Therefore, the comparator 42 produces "L" comparator output signal in the step 72 of FIG. 9. Because of "L" level output, the step 84 for storing the comparator output signal occurs after the step 4 operation. In this step 84, the "L" level is stored in the memory circuit of CPU 44 at second store position (second significant bit position) as "0" and operation is returned to the step 68 again through the step 78.

In the step 68 of the third time interval, the reference input digital signal of D/A converter 38 is set as "101000", in which MSB "1" remains without change, second significant bit is changed from "1" to "0" because second comparison result was "L", third bit is newly set as "1" and the rest remain as "0". By this setting, the voltage of level 40 ($V_{40}$) is produced from the converter 38 as a third reference voltage. Since this reference voltage of level 40 is also higher than the output voltage E (about level 39) of the time setting circuit 36, the comparator 42 produces "L" output signal and steps 72, 74, 84 and 78 are repeated again in that order.

In the step 68 of fourth time interval, the reference input digital signal of D/A converter 38 is set as "100100" and 36 level reference voltage ($V_{36}$) is produced from D/A converter 38. In this case, since the level 36 reference voltage is lower than the output voltage E (about level 39) of the time setting circuit 36, the comparator 42 produces "H" output signal and steps 72, 74, 76 and 78 are repeated in that order.

The above-mentioned operation (steps 72-74-76-78) is repeated at times $T_5$ and $T_6$ of FIG. 12 because each of 38, 39 level reference voltages is lower than the output voltage E of the time setting circuit 36. In step 78 of time $T_6$ (FIG. 12), CPU 44 detects completion of the comparison operation for all six bits. Therefore, data "100111" stored in the memory circuit of CPU 44 is read out in the step 80 and time corresponding to the output voltage E of level 39 ("100111") is displayed on the display section 26 in the step 82.

FIG. 11 illustrates the detection operation of 0 level. As is obvious from the foregoing, in this case, the reference voltage is changed as follows: first reference voltage level 32 ("100000"), second level 16 ("010000"), third level 8 ("001000"), fourth level 4 ("000100"), fifth level 2 ("000010") and sixth level 1 ("000001"). Since all of these reference voltages are higher than the output voltage E (0 level) of the time setting circuit 36, the comparator 42 produces "L" at all times $T_1$–$T_6$ of FIG. 11 and time corresponding to 0 level ("000000") is displayed on the display section 26.

According to the above-mentioned embodiment, it is possible to display 64 different time informations on the display section 26. For example, if each level of 64 different reference voltages corresponds to one minute of cooking time interval, cooking time interval display from 0 minutes until 63 minutes would be possible. If each level corresponds to ten seconds, the display from 0 second until 630 seconds (10 minutes, 30 seconds) would be possible. If the time corresponding to each level is changed appropriately or the number of levels is increased to more than 64 or decreased to less than 64, arbitrary time display would be possible.

While the variable resistor 36*a* is used in the time setting circuit 36 of the above embodiment, the time setting circuit 36 may be constructed by the use of, for example, a rotary switch having 64 terminals connected to resistors or a slidable variable resistor instead of rotary variable resistor 36*a*.

While four numeral display elements 26*a*–26*d* are all used for time display (FIG. 4) in the above embodiment, the two left-side elements 26*a*, 26*b* or the two right-side elements 26*c*, 26*d* may be used for time display if a time information to be displayed is two digits, such as 10 minutes.

In the above-mentioned embodiment in which four numeral display elements 26*a*–26*d* are all used for time display, if a switch for selecting minute display mode or second display mode is provided, a change of minute display or second display would be possible separately. The same advantage would also be obtained when two time setting knobs (one being used for setting minutes, the other for setting seconds) are provided.

In the above-mentioned embodiment, the angular position of the time setting knob 28 corresponds to the time information to be displayed on the display section 26 without wide margin. Therefore, when the knob 28 is set at a transient position between adjacent levels or external noise affects the circuit, time display may fluctuate. To solve this problem, a second embodiment of the digital timer has such characteristics which cause, for the same displayed time, a difference between the position of the time setting knob 28 during the course of incrementing the display and the position of the time setting knob 28 during the course of decrementing the display.

Figure 13:
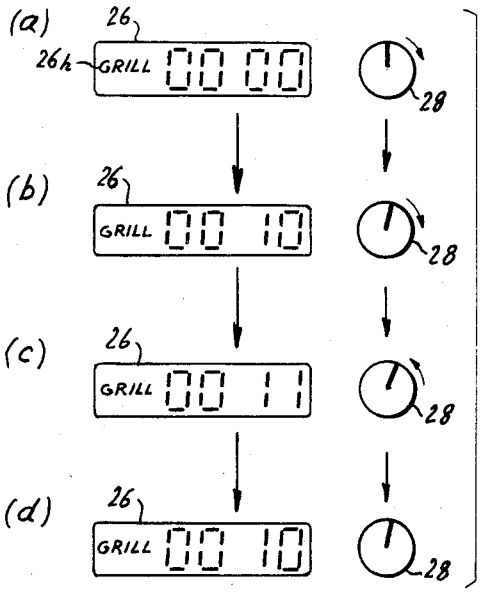
FIG. 13 is representative of the control panel of FIG. 3 used for explanation of how cooking time is changed by the use of another embodiment of the electronic digital timer.
Figure 14:
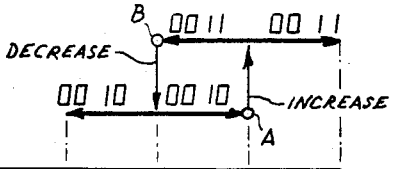
FIG. 14 is a graphical representation used for explanation of FIG. 13.

The following will further set forth the second embodiment with reference to FIGS. 13 and 14. In FIG. 13(*a*), "0000" is displayed corresponding to the initial angular position (level 0) of the time setting knob 28. When the knob 28 is turned clockwise as shown by an arrow in FIG. 13(*a*), "0010" is displayed corresponding to the angular position (level 10 in FIG. 14) of the knob 28 shown in FIG. 13(*b*). Then, the knob 28 is further turned clockwise, as shown by an arrow in FIG. 13(*b*) to the extent corresponding to an increment of the numeral display by 1, as designated from FIGS. 13(*b*) to 13(*c*), whereupon the display will be "0011" (FIG. 13(*c*)) corresponding to the angular position (level 11 in FIG. 14) of the knob 28. In this case, the increment operation occurs at point A (between levels 10 and 11) in FIG. 14. On the contrary, if the knob 28 is turned counterclockwise as shown by an arrow in FIG. 13(*c*), the display is decremented by 1 as shown in FIG. 13(*d*). Then, "0010" appears again on the display section 26. The decrementation occurs at point B (between levels 9 and 10) of FIG. 14 and said time display "0010" is continued to be displayed at the angular position of the knob 28 corresponding to level 9. As is apparent from the foregoing, there is established a difference between the angular position of the time setting knob 28 during the course of incrementing the time display and the position of the time setting knob 28 during the course of decrementing the time display. In other words, in FIG. 14, the numeral display increases from "0010" to "0011" when the rotational position of the knob 28 changes from a position corresponding to level 10 to a position corresponding to level 11 (Point A. FIG. 14), and decreases from "0011" to "0010" when the rotational position of the knob 28 changes from a position corresponding to level 10 to a position corresponding to level 9 (Point B, FIG. 14). Therefore, when knob 28 is in a position corresponding to level 10, which position is between levels 9 and 11, the number centrally displayed on the timer will depend upon the direction of rotation of the knob 28 and its previous position. If knob 28 reaches level 10 by counterclockwise rotation from a position corresponding to level 11, "0011" is displayed until knob 28 reaches the transition Point B (between 9 and 10). On the other hand, if knob 28 reaches level 10 by clockwise rotation from a position corresponding to level 9, "0010" is displayed since the transition occurs at the point corresponding to Point B. That is, when the rotational direction of the knob 28 is clockwise (display incrementing direction), time display appears corresponding to the final position of the knob 28 and when the rotation direction is counterclockwise (display decrementing direction), time display appears corresponding to previous position adjacent to final position of the knob 28.

The above-mentioned characteristics may be implemented by appropriate programming of CPU 44. For example, CPU 44 includes a memory circuit which has at least one specific storage area other than the above-mentioned storage area for the analog-to-digital (A/D) converting operations. The digital signal of six-bit configuration is restored in the specific storage area after the signal is displayed on the display section 26. The digital signal corresponding to newly set position of the time setting knob 28 is compared with the previously stored digital signal by a comparator (not shown) of CPU 44 right after the completion of A/D converting operations. At this time, CPU 44 judges the rotation direction of the time setting knob 28 on the basis of the comparison results in CPU 44. When the previous signal is smaller than the new signal, the rotation direction is clockwise (display incrementing direction) and when the previous signal is larger than the new signal, the direction is counterclockwise (display decrementing position). The CPU 44 is arranged to provide the functions described with reference to FIGS. 13 and 14 in a way which would be readily apparent to a skilled worker and therefore need not be explained in detail.

According to this embodiment, even if the time setting knob 28 is stopped at a transient position between two adjacent levels and comparison result fluctuates, the numeral display on the display section 26 is still stable and is insensitive to incoming noise because of the above-mentioned characteristics.

As stated above, the electronic digital timer is often used as a clock for displaying the present time of day when not used for cooking. The following will set forth the time adjustment operation of the third embodiment of the invention to adjust the present time. Referring to FIGS. 3, 4, 5 and 6, when the oven is not used for cooking, the digital timer is in the present time display mode and displays typically the present time, for example, "10:00" (10 o'clock) as shown in FIG. 4(*a*). At this time, when the user desires to adjust the present time to "12:59", the time adjusting button 32 (FIG. 3) is first pressed, causing time adjusting switch 32*a* (FIG. 6) to close instantaneously and the colon display element 26*e* changes from stationary lighting mode to flickering mode and hours digit display at left-hand two numeral display elements 26*a*, 26*b* changes to "00" and minutes digit display at right-hand two numeral display elements 26*c*, 26*d* disappears. Under these circumstances, the time setting circuit 36 is ready to introduce time information in the hours digit positions. When the time setting knob 28 is turned clockwise and "12" display appears on the display elements 26*a*, 26*b*, the time setting button 32 is pressed again and thus the hour digit setting is completed. In this case, however, clock operation is still stopped and will not change until the minute digit setting being completed. At the same time of the second actuation of the time setting button 32, minute digit display at the display elements 26*c*, 26*d* appears at "00". Under these circumstances, the time setting circuit 36 is ready to introduce time information in the minutes digit positions. When the time setting knob 28 is further turned clockwise and "59" display appears on the display elements 26*c*, 26*d*, the time setting button 32 is actuated again the thus minute digit setting is completed. At the same time, the colon display segment 26*e* is returned from the flickering mode to the stationary lighting mode and clock operation is started again to update the adjusted present time display of 12:59. Time adjustment operation is executed in the above-mentioned manner. According to the third embodiment, it is possible to set time as long as the time setting circuit 36 produces at least sixty levels and these levels are converted into corresponding digital signals.

As stated above, the procedure, like the above-mentioned time adjustment procedure, could also be used as cooking time setting procedure. Two time setting knobs 28 may be provided for setting time on left-hand display elements 26*a*, 26*b* and for setting time on right-hand display elements 26*c*, 26*d*.

While the above-mentioned embodiments indicate the digital timers used for clocks and as interval timers, the digital timers may also be used for setting an initiating cooking time and/or terminating cooking time. In this case, a programming button may be provided for programming said initiating time and/or terminating time in CPU 44. For example, at 9:00 (present time), when the user desires to initiate the cooking at 10:30 and terminate it at 11:00, the programming button is first pressed instantaneously and the present time display disappears. The time "10:30" is set by rotating the time setting knob 28. The programming button is pressed instantaneously again and the set time display disappears. The time "11:00" is set by rotating the time setting knob 28 again. Under these circumstances, when the "COOK" key is pressed, the present time display appears again on the display section 26. When the present time reaches to the set time "10:30", the microwave oven is automatically initiated for cooking and when the present time reaches to "11:00", the cooking operation is automatically terminated. Setting of the initiating time and cooking time interval could also be possible.

While there have been described what are at present invention considered to be preferred embodiments of the invention, it will be understood that various modifications may be made therein, for example: (1) to replace the rotary variable resistor 36*a* with the rotary switch or slidable variable resistor; (2) use of only two numeral display elements of the display device 26*x* for time display; (3) providing two time setting knobs 28 for setting time on two left-hand numeral display elements and for setting time on two right-hand display elements; and it is intended to cover in the appended claims all such modifications as fall within the true spirit and scope of the invention.

What is claimed is:

1. An electronic digital timer for displaying time information and time interval information on an electronic digital display device, comprising:

at least one time setting knob rotatable through a selectable angle representative of a selected time interval;

time setting circuit means responsive to the rotation of said time setting knob for producing an output voltage corresponding to the selected position of said time setting knob;

microcomputer means for producing a digital reference input signal;

digital-to-analog converter means for receiving said digital reference input signal and producing therefrom an analog signal;

comparator means for comparing the output voltage of said time setting circuit means with the analog signal produced by said digital-to-analog converter and producing a comparator output signal indicative of said comparison, said comparator output signal being applied to an input of said microprocessor wherein said comparator output signal is stored;

means of periodically changing the digital reference signal a pre-determined number of times, each of the digital reference signals being applied to the digital-to-analog converter the output of which is applied to said comparator wherein it is compared with the output voltage of said time setting means to produce a plurality of comparator output signals which are stored in said microcomputer;

display means coupled to receive said stored signals for producing a digital display of the desired time interval.

2. An electronic digital timer for use in controlling the operation of an auxiliary device during a selected time interval:

a time setting knob rotatable through a selectable angle representative of a time interval during which the auxiliary device will operate;

a time setting circuit including a variable resistor having a movable arm, the position of which is controlled by the time setting knob, for producing an output voltage determined by the position of said movable arm;

processing means for producing a reference input digital signal;

a digital-to-analog converter for converting said reference input digital signal into a corresponding analog reference output voltage;

a comparator for comparing the output voltage of the time setting circuit with the analog reference output voltage and producing a comparator output signal indicative of the results of such comparison;

said processing means coupled to receive and store the comparator output signal and to periodically change the reference input digital signal a predetermined number of times resulting in a plurality of comparator output signals being stored in said processing means;

a display control means responsive to said comparator output signals stored in said processor means for displaying the time interval corresponding to said stored digital signal, said process having such characteristics which causes, for a particular desired time display, a difference between the position of the time setting knob during the course of incrementing the display and the position of the time setting knob during the course of decrementing the display; and control means coupled to said processing means for selectively controlling said auxiliary device during the displayed selected time interval.

3. In a microwave oven having an electronic digital timer for displaying time information on an electronic digital display device and for use in controlling the operation of said microwave oven during a selected time interval, comprising:

a magnetron circuit for producing microwave energy;

time setting means adjustable to provide selected time settings represented by the amount of movement of aid time setting means for selecting a time interval during which the microwave oven will operate:

time setting circuit responsive to the time setting means for producing an output voltage corresponding to the position of said time setting means;

microcomputer means for producing a digital reference input signal;

digital-to-analog converter means for receiving said digital reference input signal and producing therefrom an analog signal;

comparator means for comparing the output voltage of said time setting circuit means with the analog signal produced by said digital-to-analog converter and producing a comparator output signal indicative of said comparison, said comparator output signal being applied to an input of said microprocessor wherein said comparator output signal is stored;

means of periodically changing the digital reference input signal a pre-determined number of times, each of the digital reference signals being applied to the digital-to-analog converter the output of which is applied to said comparator wherein it is compared with the output voltage of said time setting circuit means to produce a plurality of comparator output signals which are stored in said microcomputer;

display means coupled to receive said stored signals for producing a digital display of the desired time interval, whereby for a particular desired time display, a difference exists between the position of the time setting means during the course of incrementing the display and the position of the time setting means during the course of decrementing the display; and control circuit means including a drive circuit for selectively controlling said magnetron circuit during the selected time interval displayed on said electronic digital display device.

* * * * *